US007956764B2

(12) United States Patent
Morris

(10) Patent No.: US 7,956,764 B2
(45) Date of Patent: Jun. 7, 2011

(54) AMBIENT CONDITION DETECTOR WITH VARIABLE PITCH ALARM

(76) Inventor: Gary Jay Morris, Morgantown, WV (US)

( * ) Notice: Subject to any disclaimer, the term of this patent is extended or adjusted under 35 U.S.C. 154(b) by 68 days.

(21) Appl. No.: 12/589,019

(22) Filed: Oct. 16, 2009

(65) Prior Publication Data

US 2010/0039257 A1 Feb. 18, 2010

Related U.S. Application Data

(63) Continuation of application No. 11/595,031, filed on Nov. 9, 2006, now Pat. No. 7,605,687.

(51) Int. Cl.
*G08B 25/08* (2006.01)

(52) U.S. Cl. ..... 340/692; 340/384.73; 340/577; 340/632; 340/628; 340/629; 340/521; 340/533

(58) Field of Classification Search ..... 340/692, 340/384.73, 577, 632, 628, 629, 521, 533
See application file for complete search history.

(56) References Cited

U.S. PATENT DOCUMENTS 4,600,914 A 7/1986 Walsh
4,602,246 A 7/1986 Jensen
4,688,021 A 8/1987 Buck et al.
4,926,159 A 5/1990 Bartlett
4,935,952 A 6/1990 Dutra
5,349,338 A 9/1994 Routman
5,576,685 A * 11/1996 Saito ..... 340/384.1
5,663,714 A 9/1997 Fray
5,808,541 A 9/1998 Golden
5,990,797 A 11/1999 Zlotchenko
6,078,269 A 6/2000 Markwell
6,114,967 A 9/2000 Yousif
6,133,839 A 10/2000 Ellul et al.
6,232,882 B1 5/2001 Hed et al.
6,323,780 B1 11/2001 Morris
6,426,703 B1 7/2002 Johnston et al.
6,522,248 B1 * 2/2003 Andres et al. ..... 340/521
6,553,100 B1 4/2003 Chen et al.
6,658,123 B1 12/2003 Crutcher
6,690,288 B1 2/2004 Waddell
6,768,424 B1 7/2004 Morris
6,784,798 B2 8/2004 Morris
6,819,257 B2 11/2004 Swieboda
6,838,994 B2 1/2005 Gutta et al.
6,873,254 B2 3/2005 Andres
6,970,077 B2 11/2005 Johnson (Continued)

OTHER PUBLICATIONS

Ball et al, "The Effect of Alcohol upon Response to Fire Alarm Signals in Sleeping Young Adults", Proceedings of 3rd International Symposium on Human Behaviour in Fire, Sep. 2004, Belfast, Northern Ireland, London: Interscience Communications pp. 291-302.

(Continued)

*Primary Examiner* — Tai T Nguyen
(74) *Attorney, Agent, or Firm* — Gary J. Morris

(57) ABSTRACT

An ambient condition detector outputs an alarm comprising a tonal pattern comprising at least two distinctly different pitch tones in one embodiment of the invention. Another embodiment comprises a detector whereby a user can select a pitch tone to be output within a tonal pattern alarm when the detector senses an ambient condition. Options include verbal output to indicate the type of ambient condition sensed and/or the location of the detector sensing the ambient condition.

20 Claims, 9 Drawing Sheets

U.S. PATENT DOCUMENTS

| | | | |
|---|---|---|---|
| 7,034,703 | B2 | 4/2006 | Morris |
| 7,068,176 | B2 | 6/2006 | Black et al. |
| 7,170,397 | B2 | 1/2007 | Roby et al. |
| 7,170,404 | B2 | 1/2007 | Albert et al. |
| 7,372,370 | B2 | 5/2008 | Stults et al. |
| 2002/0130782 | A1 | 9/2002 | Johnston et al. |
| 2006/0214809 | A1 | 9/2006 | Sistare |

OTHER PUBLICATIONS

Bruck et al, "Recognition of Fire Cues During Sleep", 2001, Proceedings of Second International Symposium on Human Behaviour in Fire, London Interscience Communications, pp. 241-252.

Ball et al, "The Salience of Fire Alarm Signals for Sleeping Individual: A Novel Approach to Signal Design", Sep. 2004, Proceedings of 3rd International Symposium on Human Behaviour in Fire, Belfast, Northern Ireland, London: Interscience Communications, pp. 303-314.

Bruck et al, "The Effective or Different Alarms In Waking Sleeping Children", Sep. 2004, Proceedings of 3rd International Symposium on Human Behaviour in Fire, Belfast, Northern Ireland, London: Interscience Communications, pp. 279-290.

Bruck et al, "Reducing Fire Deaths in Older Adults: Optimizing the Smoke Alarm Signal Research Project", The Fire Protection Research Foundation, May 2006.

Task Force to Study Visual Smoke and Evacuation Alarms for the Deaf and Hard of Hearing, State of Maryland Governor's Office of the Deaf and Hard of Hearing, Sep. 2006.

Loudenlow Smoke Alarm—The Darrow Company, Apr. 3, 2005 http://web.archive.org/web/20050403225154/http://loudenlow.com/.

All above documents found in the File Wrapper of the Parent U.S. Appl. No. 11/595,031.

* cited by examiner

AMBIENT CONDITION DETECTOR WITH VARIABLE PITCH ALARM

CROSS REFERENCE TO RELATED APPLICATIONS

This patent application is a continuation of utility patent application having Ser. No. 11/595,031 now issued as U.S. Pat. No. 7,605,687 having a filing date of Nov. 9, 2006 which is incorporated herein in its entirety by reference. This patent application claims the benefit of the priority date of its above referenced parent application.

BACKGROUND

The pitch of tones within tonal patterns emitted by ambient condition detector units and systems in the alarm or testing state is not always optimum to be heard by a wide range of users. As one example, the elderly often suffer from a deficit of high frequency hearing sensitivity and may hear a lower pitch tonal pattern better than a higher pitch pattern. Other users may respond better to a higher pitch tonal pattern. As another example, various types of ambient noise may result in a tonal pattern containing preferred pitch tones that could most readily be heard in the event of a sensed ambient condition. Many conventional ambient condition detectors emit a tonal pattern with an average tone pitch on the order of 3 kHz in frequency.

BRIEF DESCRIPTIONS OF THE DRAWINGS

DETAILED DESCRIPTION

Figure 1:
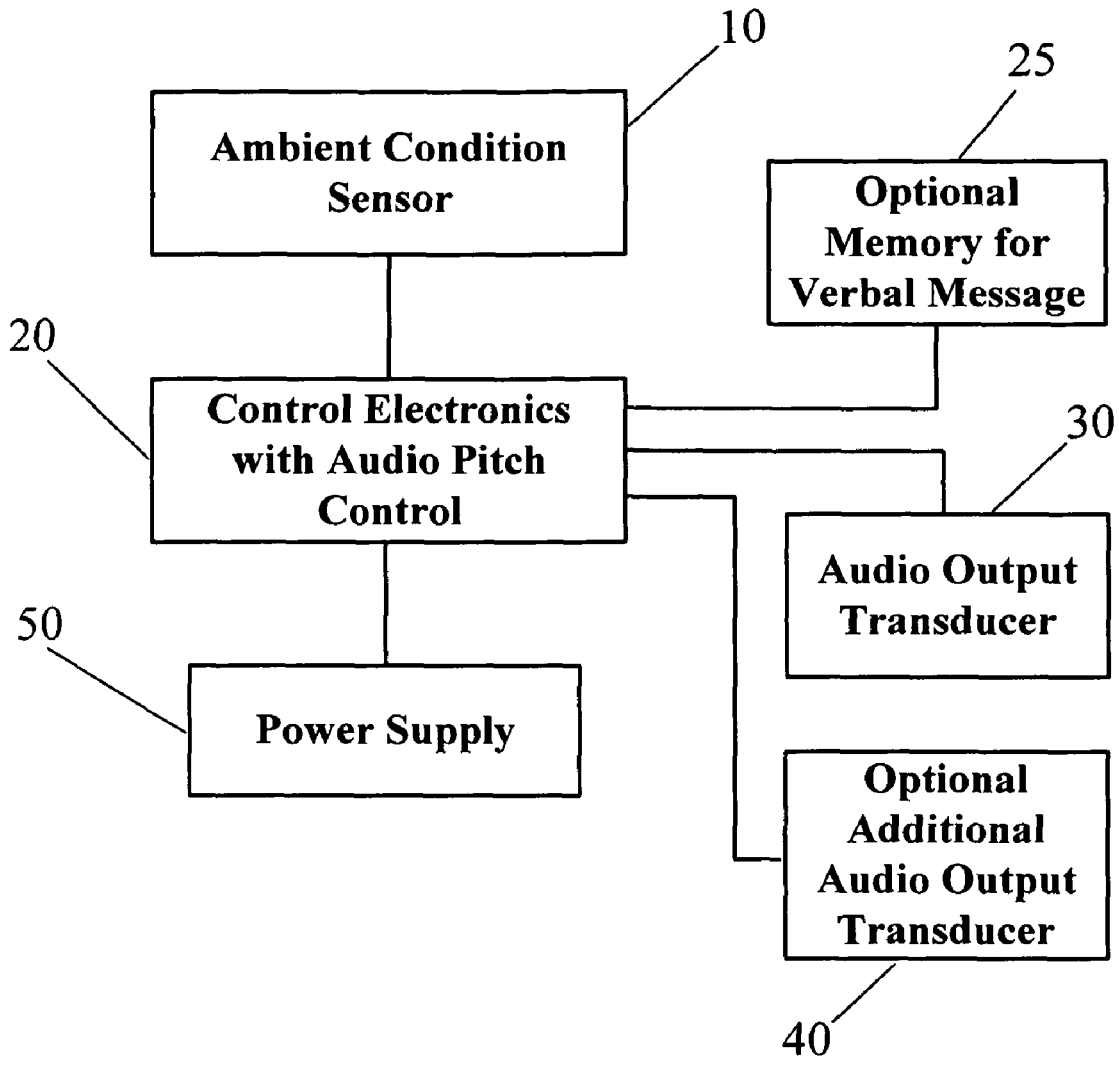
FIG. 1 is a block diagram of one embodiment of the invention using control electronics with audio pitch control capability to control the pitch of the tones emitted by the audio output transducer.

While the various embodiments of this invention can take many different forms, specific embodiments thereof are shown in the drawings and will be described in detail herein with the understanding that the present disclosure is to be considered as an exemplification of the principles of the invention and is not intended to limit the scope of the invention to any specific embodiments illustrated or described.

One of the embodiments is an ambient condition detector unit shown in FIG. 1 where an ambient condition sensor 10 is connected to control electronics with audio pitch control 20 such that sensing of an ambient condition by ambient condition sensor 10 provides an input signal to the control electronics with audio pitch control 20. The control electronics with audio pitch control 20 may be microprocessor based in one embodiment, and may be ASIC based in another embodiment and may contain electronic memory for one or more alarm tonal patterns comprising one or more pitch tones included within the tonal patterns and one or more silent periods within the tonal patterns. When the ambient condition sensor 10 senses an ambient condition, the control electronics with audio pitch control 20 sends an output signal to the audio output transducer 30 such that the audio output transducer 30 emits a tonal pattern comprising tones having pitch controlled by the control electronics with audio pitch control 20. The control electronics with audio pitch control 20 controls the tonal pattern and tonal pitch.

Figure 3:
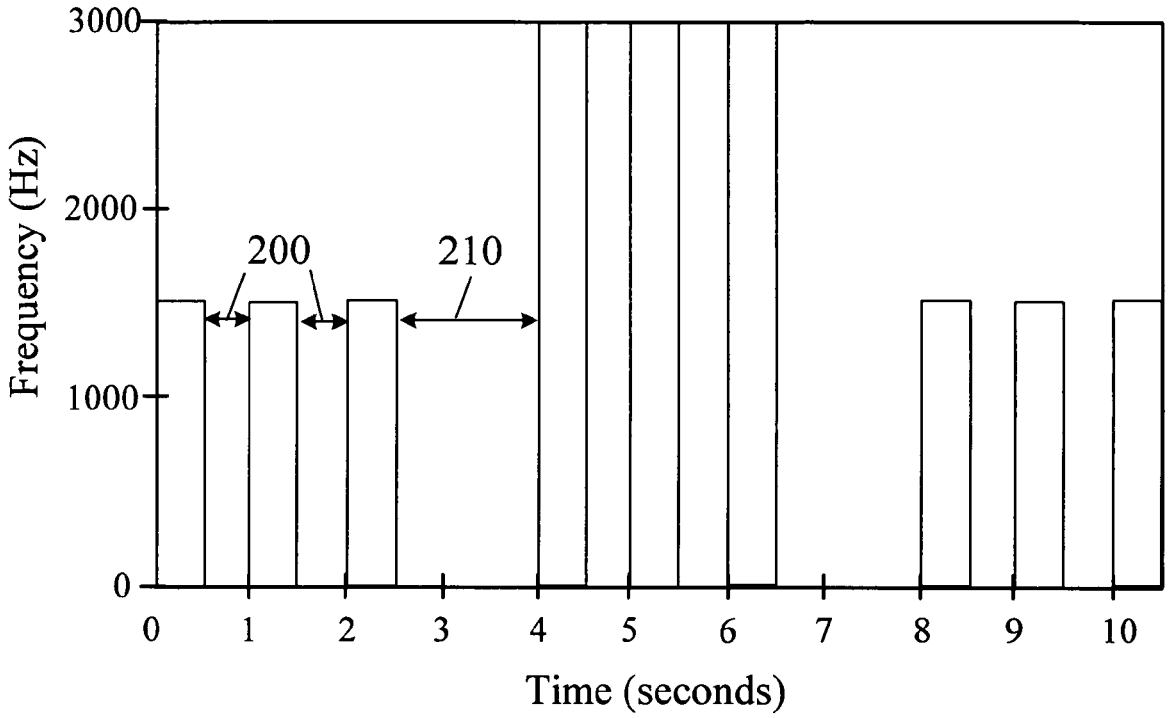
FIG. 3 is an example tonal pattern illustrating an inter-group alternating pitch sequence in one embodiment.
Figure 4:
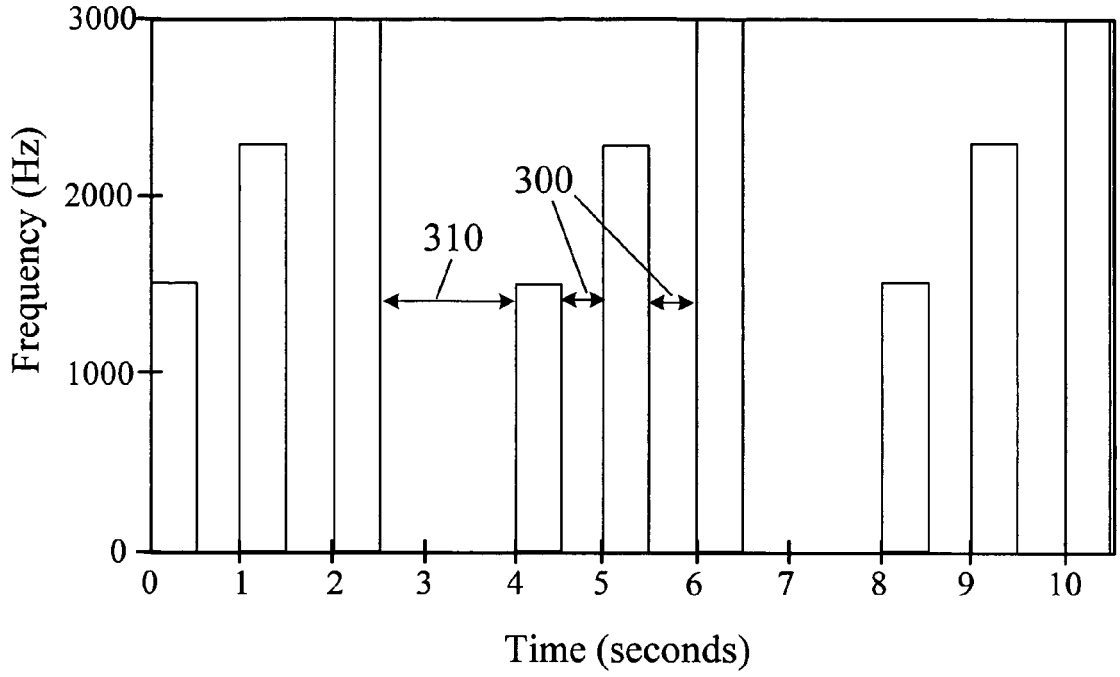
FIG. 4 is an example tonal pattern illustrating a ramped intra-group pitch sequence in one embodiment.
Figure 5:
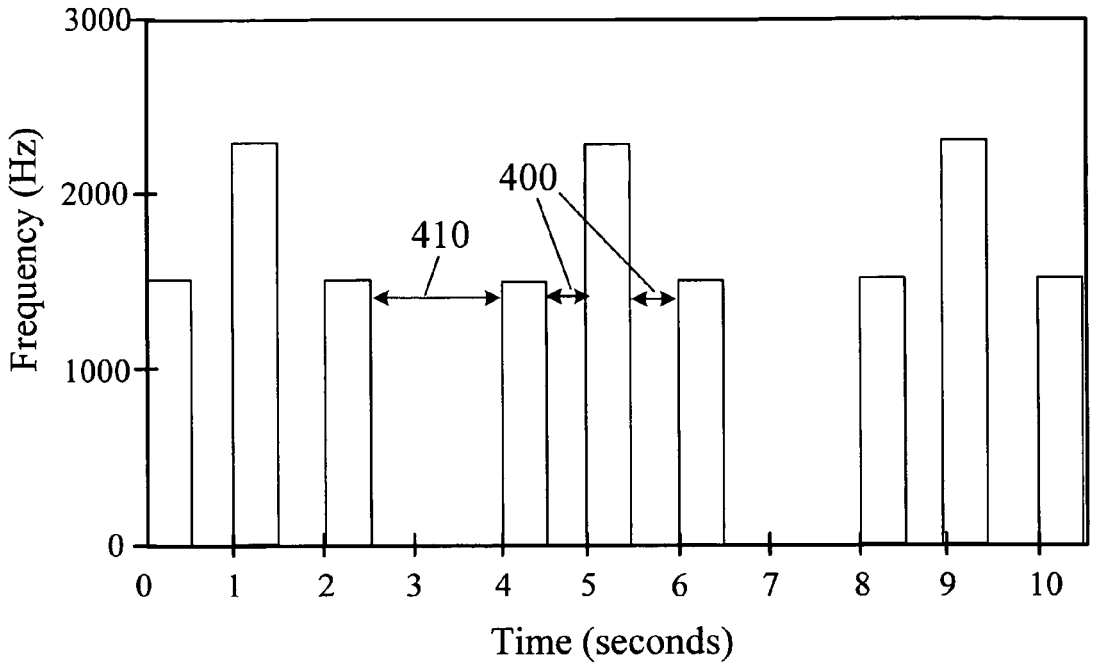
FIG. 5 is an example tonal pattern illustrating an alternating intra-group pitch sequence in one embodiment.

In at least one embodiment, a tone group comprises tones separated by at least one silent period. The silent period between repeating of the tone group is longer than the silent periods within the tone group. For example, in FIG. 3, FIG. 4, and FIG. 5 the first three tones illustrated comprise a first tone group and the second three tones illustrated in each figure comprise a second tone group separated from the first tone group by at least twice the time present between any two tones within a tone group. Times between tone groups are called inter-group temporal spacing 210, 310, and 410 and times between individual tones within a tone group are call intra-group temporal spacing 200, 300, and 400. It is noted that the illustrative example of three tones in a tone group as shown in FIG. 3, FIG. 4, and FIG. 5 are not intended to be limiting. More or less than three tones may comprise a tone group, in general, as is shown in an example in FIG. 6.

In one embodiment, the tonal pattern comprises tone groups with intra-group temporal spacing of a first amount and inter-group temporal spacing of a second amount wherein the second amount is at least twice as much as the first amount wherein the tones comprise at least two distinctly different pitches.

Distinctly different pitches means that a normal human ear can detect a difference between the pitches (often referred to a just noticeable difference). As one example, the just noticeable difference in pitch for the normal human ear is on the order of 0.5% of the tone frequency when that tone frequency is on the order of a few thousand hertz. Other values of just noticeable differences in pitch for the normal human ear are well known in the field of acoustics. It is noted that tone pitches may be composites of more than one tone frequency and still fall within the scope of the invention. As such, distinctly different pitches may also be composites of more than one tone frequency so long as a normal human ear can detect an audible difference between such pitches.

As little as one tone may be contained within a tone group in another embodiment, in which case the intra-group temporal spacing would go to zero and the inter-group temporal spacing would be the only spacing between tones.

Sample tonal patterns with varying pitch sequences of various embodiments are shown in FIG. 3, FIG. 4, FIG. 5, and FIG. 6.

Tonal patterns are comprised of at least one tone group and are differentiated by the number of tones and temporal spacings between the tones within the tone groups (intra-group temporal spacing) and the temporal spaces between repeated tone groups (inter-group temporal spacing). As an example, FIG. 3, FIG. 4, and FIG. 5 illustrate the same tonal pattern but contain different pitch tones or different pitch sequences. Silent periods or silent times of a tonal pattern refer to times when no tonal alarm is present; however, silent periods or times do not preclude the presence of a non-tonal emission such as a verbal output.

In at least one embodiment, the tonal pattern(s) and distinctly different pitch tones are factory set and are not user selectable.

In one embodiment, verbal output is used to describe the type of condition sensed or the location of the detector sensing the condition, or both, or instructions on how to remain safe in accordance with the sensed to condition. At least one word is used to describe the type of ambient condition or location of the ambient condition sensed. In this embodiment, the control electronics with audio pitch control 20 contains voice synthesis circuitry to electronically output a recorded verbal message held in memory 25 to the audio output transducer 30 or additional audio output transducer 40 when there are silent periods in the tonal pattern. The control electronics with audio pitch control 20 contains circuitry to determine which ambient sensor within the ambient condition detector sensed the condition in embodiments with a plurality of different ambient condition sensors and can thereby output the appropriate verbal message to indicate the type of condition sensed.

In another embodiment having verbal output, the optional location selector 35 is present and connected to the control electronics with audio pitch control 20 where the location selector 35 is used to select the location where the ambient condition detector is installed, said location information is stored within the control electronics with audio pitch control 20. In this embodiment, the optional memory for verbal messages 25 is present and includes memory space to store at least one verbal message indicative of the installation location of the ambient condition detector. Example location messages include but are not limited to "basement", "kitchen", "living room", "bedroom", "utility room", "second floor", etc. When the ambient condition sensor 10 senses an ambient condition, the control electronics with audio pitch control 20 outputs a tonal pattern to the audio output transducer 30, whereby during at least one silent period occurring within the tonal pattern, at least one word of a verbal message is output to indicate the location of the ambient condition detector sensing the ambient condition. The optional location selector 35 is accessible to the user and may take the form, without limitation, of a DIP switch, a jumper(s), a rotary switch, an electrical contact, or momentary switch in various embodiments. Only embodiments which emit verbal output include optional memory for verbal message 25.

In at least one embodiment, an optional additional audio output transducer(s) 40 may be included to most effectively emit specific pitches of the alarm tones. This may be particularly useful, but not required, where piezoelectric elements are used for the audio output devices or in embodiments where verbal output is used. The audio output device 30 is a speaker in at least one embodiment.

In one embodiment, two different ambient condition sensors are included within the same unit to sense two different ambient conditions wherein the tonal patterns for each sensed condition are different and the pitches of the tones, within the respective tonal patterns, may be the same or distinctly different. In one such embodiment, one ambient condition sensor is a smoke or fire sensor and the other sensor is a gas sensor such as carbon monoxide or natural gas.

The power supply 50 is a battery power supply in one embodiment, an AC power supply in another embodiment, an AC power supply with battery back-up in another embodiment, and a hardwired DC power supply in another embodiment. The power supply 50 provides electrical power to the electrical components of the ambient condition detector unit.

Figure 2:
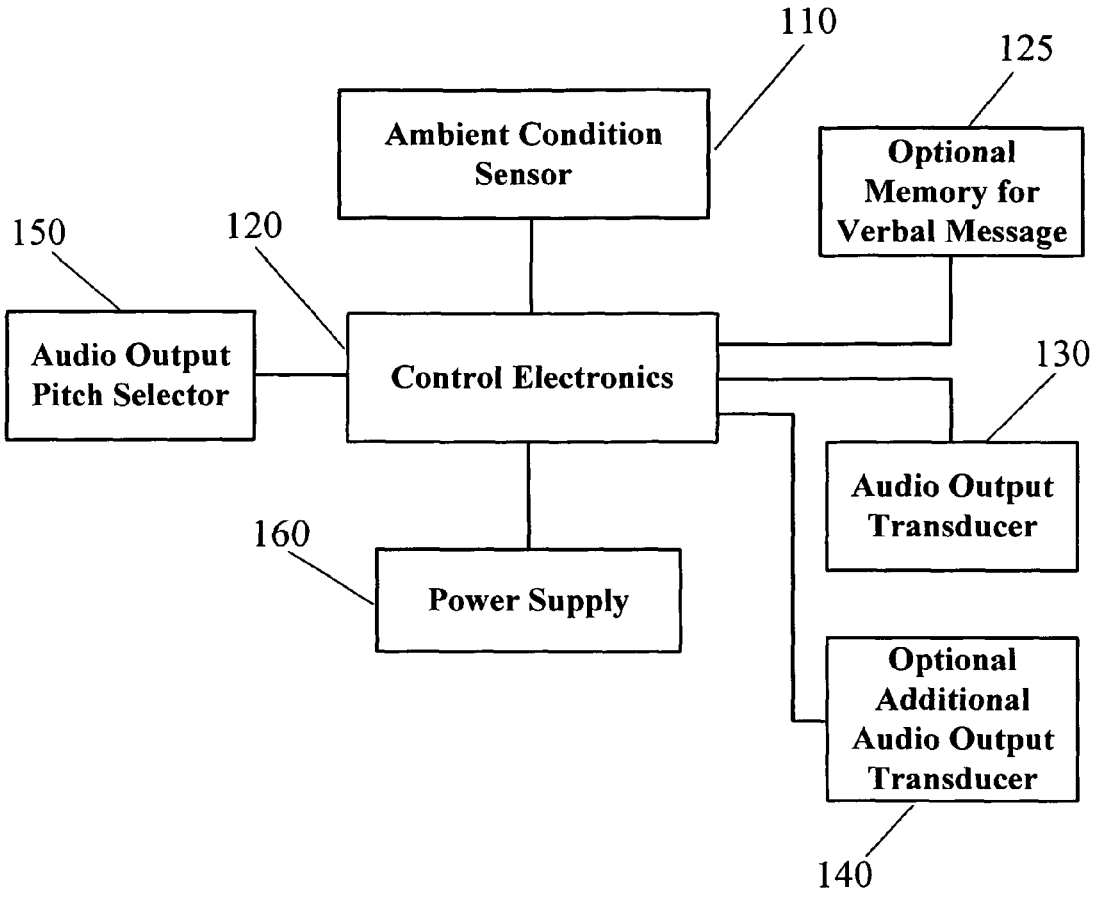
FIG. 2 is a block diagram of one embodiment of the invention using an audio output pitch selector to control the pitch of the tones emitted by the audio output transducer.

Another embodiment is an ambient condition detector unit shown in FIG. 2 where an ambient condition sensor 110 is connected to control electronics 120 such that sensing of an ambient condition by ambient condition sensor 110 provides an input signal to the control electronics 120. The control electronics 120 is microprocessor based in one embodiment and may be ASIC based in another embodiment and may contain electronic memory for one or more alarm tonal patterns containing one or more tone pitches included within tone groups or between successive tone groups and one or more silent periods within the tonal patterns. The control electronics 120 may further include electronic storage to store an identifier, such as an electronic memory pointer, to indicate which tonal output is selected by the user through the audio output pitch selector 150. Alternatively, in another embodiment, the configuration or position of the audio output pitch selector 150 is read by the control electronics 120 to determine the user's selection of the desired tonal output. The control electronics 120 sends an output signal to the audio output transducer 130 such that the audio output transducer 130 emits a tonal pattern having at least one pitch controlled by the control electronics 120 as electronically directed by the input of the audio output pitch selector 150. The control electronics 120 controls the tonal pattern and tone pitch in one embodiment. Alternatively, the audio output transducer 130 has included circuitry to control the pitch of the tonal output, but selection of pitch is controlled by the control electronics 120 as electronically directed by the input of the audio output pitch selector 150.

A user may interface with the audio output pitch selector 150 in various ways in various embodiments. The audio output pitch selector 150 is a multi-position switch in one embodiment, a DIP switch in another embodiment, a variable resistor in another embodiment, a momentary switch in another embodiment, a jumper in another embodiment, and a receiver of radiant energy, such as but not limited to an infrared light receiver or radio frequency, in another embodiment. The audio output selector 150 is connected to the control electronics 120. In an embodiment where the audio output pitch selector 150 comprises an infrared energy receiver or radio frequency signal receiver, the electronics contained therein decodes the incoming signal to interface to the control electronics 120 to select the tone pitch desired.

Figure 7:
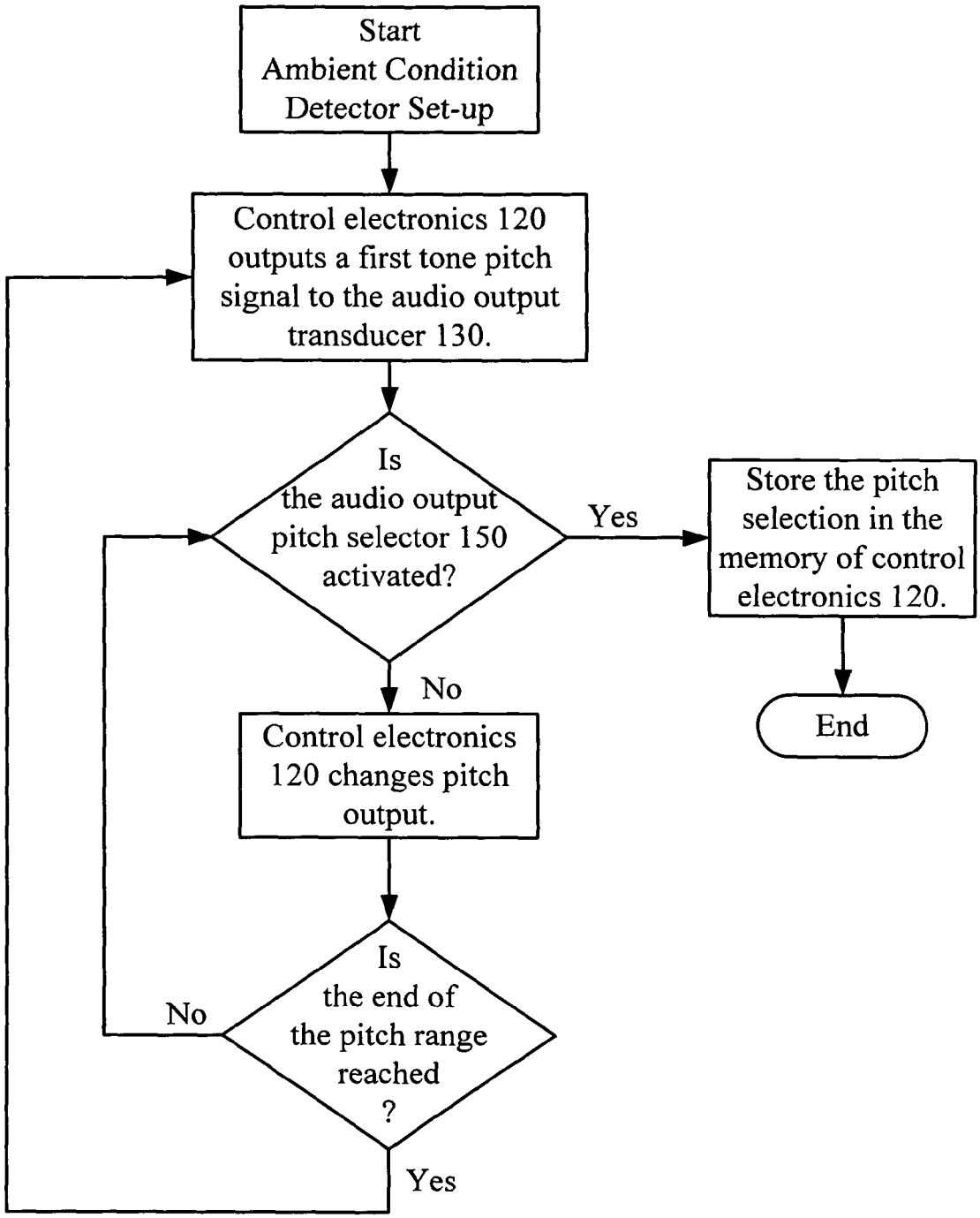
FIG. 7 is a flow chart of an electronic instruction set to permit the user to select a pitch of at least one tone to be output when an ambient condition is detected.

In one embodiment, user interfacing with the audio output pitch selector 150 permits the user to select at least one pitch of a tone within the emitted tonal pattern from the audio output transducer 130 by activating the audio output pitch selector 150 when the desired pitch is heard by the user during setup of the ambient condition detector (often as part of installation of the detector) as the control electronics 120 drives the audio transducer 130 to play through a menu of pre-programmed pitches and/or tonal patterns of varying pitch from which the user may select. The menu is stored within the control electronics 120. The tonal patterns may include silent periods. At least one software or firmware program or similar electronic instruction is stored within the control electronics 120 to output a range of tone pitches to the audio output transducer 130 and to identify the user-selected pitch when selected by the user during ambient condition detector setup and/or installation as shown in FIG. 7 as a non-limiting example. In one embodiment, during set-up of the ambient condition detector, the control electronics plays through the menu of pre-programmed tonal patterns which comprise at least two distinctly different pitch tones. When the user hears the tonal pattern with the desired pitch content, the user activates the audio output pitch selector 150 to store that selection identifier (electronic memory location pointer in one embodiment) into the memory of the control electronics 120.

Figure 9:
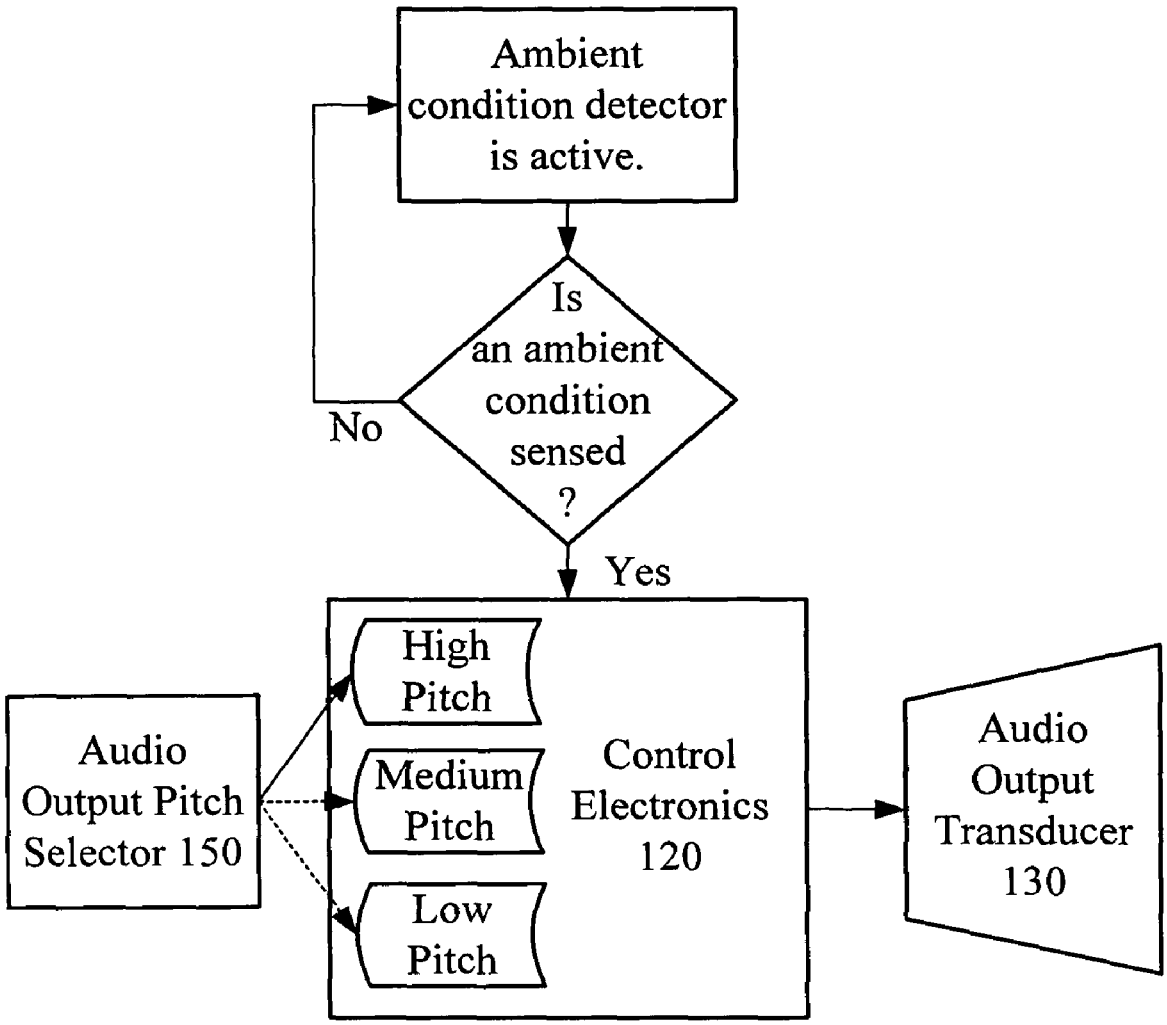
FIG. 9 illustrates one example of the flow diagram for a user-selected tone pitch for one embodiment with low, medium, and high pitches (high pitch selection indicated by the solid arrow in this example).

In another embodiment, the audio output pitch selector 150 is used to permit the user to make a selection from a choice of two or more distinctly different pitch tone groups, each tone group comprised of equal pitch tones, within tonal patterns factory-stored within the control electronics 120. The tone group choices may include silent periods. As a non-limiting example in one embodiment, the user may employ the audio output pitch selector 150 to choose from low, medium, and high pitch selections for the output tonal pattern where low, medium, and high may refer to pitch frequencies on the order of 1000 Hz, 2000 Hz, and 3000 Hz, respectively, as just one example. FIG. 9 illustrates one example of the flow diagram for a user selected pitch for one embodiment with low, medium, and high pitches. This diagram may apply to more or less than three pitch selections. In this embodiment, the audio output pitch selector 150 instructs the control electronics 120 which factory-stored, tonal pitch sequence to send to the audio output transducer 130 when an ambient condition is detected.

Figure 8:
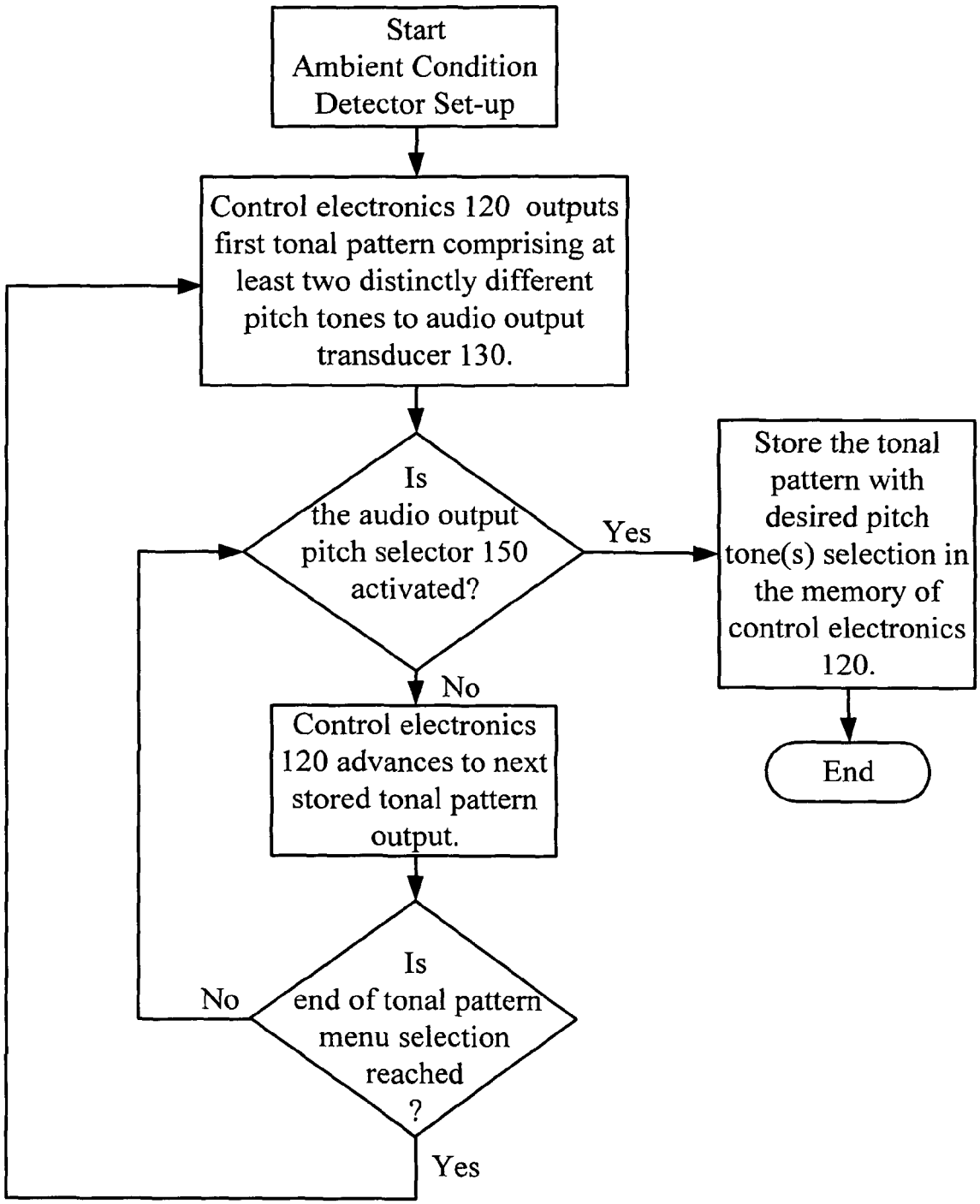
FIG. 8 is a flow chart of an electronic instruction set to permit the user to select a tonal pattern comprising at least two distinctly different pitch tones when an ambient condition is detected.

In another embodiment, user interfacing with the audio output pitch selector 150 permits the user to select from two or more alarm tones each comprising at least two distinctly different tonal pitches emitted from the audio output transducer 130. At least one software or firmware program or similar electronic instruction to yield the at least two distinctly different tonal pitches within tone groups or between tone groups is stored electronically within the control electronics 120 in one embodiment. One flow chart illustration of an electronic instruction is shown in FIG. 8 as a non-limiting example. In at least one embodiment, a tone group comprises tones separated by at least one silent period. The time between repeating of the tone group is longer than the silent periods within the tone group. For example, in FIG. 3, FIG. 4, and FIG. 5 the first three tones illustrated in each figure comprise a first tone group and the second three tones illustrated comprise a second tone group separated from the first tone group by at least twice the time present between any two tones within a tone group. Times between tone groups are called inter-group temporal spacing 210, 310, and 410 and times between individual tones within a tone group are call infra-group temporal spacing 200, 300, and 400. It is noted that the illustrative example of three tones in a tone group as shown in FIG. 3 is not intended to be limiting. More or less than three tones may comprise a tone group, in general as is shown in an example in FIG. 6.

As little as one tone may be contained within a tone group in one embodiment, in which case the intra-group temporal spacing would go to zero and the inter-group temporal spacing would be the only spacing between tones.

In at least one embodiment, the tonal pattern comprises tone groups with intra-group temporal spacing of a first amount and inter-group temporal spacing of a second amount wherein the second amount is at least twice as much as the first amount. Sample tonal patterns with varying pitch sequences of various embodiments are shown in FIG. 3, FIG. 4, FIG. 5, and FIG. 6.

Tonal patterns are comprised of at least one tone group and are differentiated by the number of tones and temporal spacings between the tones within the tone groups (intra-group temporal spacing) and the temporal spaces between repeated tone groups (inter-group temporal spacing). As an example, FIG. 3, FIG. 4, and FIG. 5 illustrate the same tonal pattern but contain different pitch tones or different pitch sequences. Silent periods or silent times of a tonal pattern refer to times when no tonal alarm is present; however, silent periods or times do not preclude the presence of a non-tonal emission such as a verbal output.

In one embodiment, verbal output is used describe the type of condition sensed or the location of the detector sensing the condition, or both, or instructions on how to remain safe in accordance with the sensed to condition. At least one word is used to describe the type of ambient condition or location of the ambient condition sensed. In this embodiment, the control electronics 120 contains voice synthesis circuitry to electronically output a recorded verbal message held in memory 125 to the audio output transducer 130 or additional audio output transducer 140. Only embodiments which emit verbal output include optional memory for verbal message 125. The control electronics 120 contains circuitry to determine which ambient sensor within the ambient condition detector sensed the condition in embodiments with a plurality of different ambient condition sensors and can thereby output the appropriate verbal message to indicate the type of condition sensed.

In another embodiment having verbal output, the optional location selector 135 is present and connected to the control electronics 120 where the optional location selector 135 is used to select the location where the ambient condition detector is installed, said location information is stored within the control electronics 120. In this embodiment, the optional memory for verbal messages 125 is present and includes memory space to store at least one verbal message indicative of the installation location of the ambient condition detector. Example location messages include but are not limited to "basement", "kitchen", "living room", "bedroom", "utility room", "second floor", etc. When the ambient condition sensor 110 senses an ambient condition, the control electronics 120 outputs a tonal pattern to the audio output transducer 130, whereby during at least one silent period occurring within the tonal pattern, at least one word of a verbal message is output to indicate the location of the ambient condition detector sensing the ambient condition. The optional location selector 135 is accessible to the user and may take the form, without limitation, of a DIP switch, a jumper, a multi-position switch, an electrical contact, or momentary switch in various embodiments. Only embodiments which emit verbal output include optional memory for verbal message 125.

In at least one embodiment, an additional audio output transducer(s) 140 may be included to most effectively emit specific pitches of the alarm tones. This may be particularly useful, but not required, where piezoelectric elements are used for the audio output devices or in embodiments where verbal output is used. An audio output device 130 is a speaker in at least one embodiment.

The power supply 160 is a battery power supply in one embodiment, an AC power supply in another embodiment, an AC power supply with battery back-up in another embodiment, and a hardwired DC power supply in another embodiment. The power supply 160 provides electrical power to the electrical components of the ambient condition detector unit.

Figure 6:
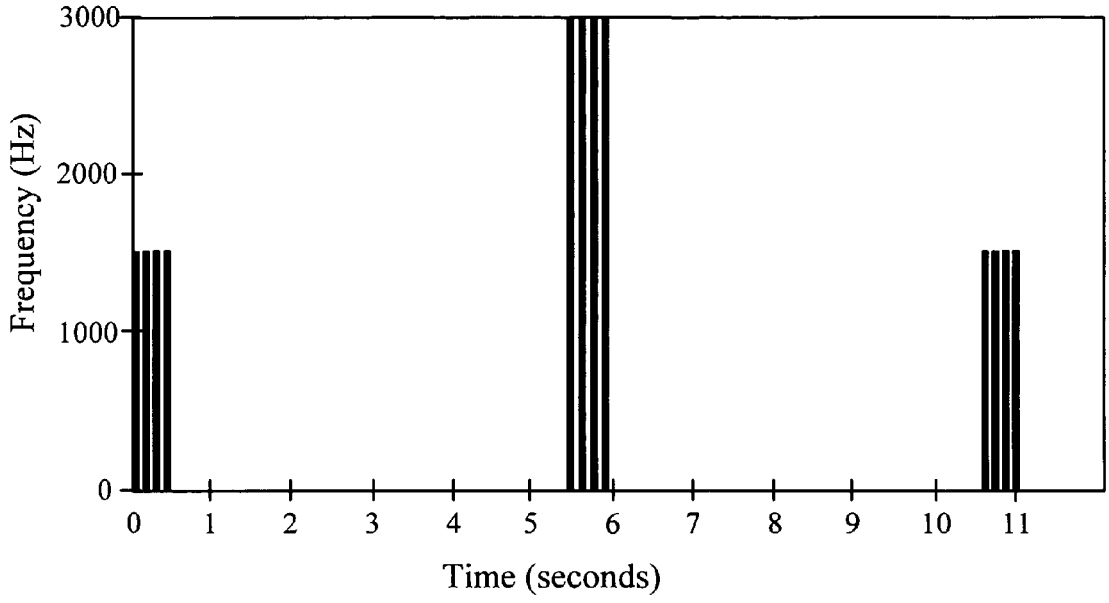
FIG. 6 is an example tonal pattern illustrating an inter-group alternating pitch sequence typically used in one gas detector embodiment.

Various sample pitch sequences of tonal patterns are illustrated in FIG. 3, FIG. 4, FIG. 5, and FIG. 6 for various embodiments and are in no way intended to be limiting but serve as exemplary tonal patterns having at least two distinctly different pitch tones which may output by the ambient condition detector. While the sample, triple tonal groupings (FIGS. 3-5) are most relevant to smoke or fire detector embodiments of the ambient condition detector, similar variable pitch tonal patterns may be output for other ambient condition detectors such as gas detectors which may output a quadruple tonal grouping within one embodiment (FIG. 6).

FIG. 3 illustrates an inter-group alternating pitch sequence for a tonal pattern of one embodiment where the inter-group temporal spacing 210 is at least twice the amount of the intra-group temporal spacing 200.

FIG. 4 illustrates an inter-group ramping pitch sequence for a tonal pattern of one embodiment where the inter-group temporal spacing 310 is at least twice the amount of the intra-group temporal spacing 300.

FIG. 5 illustrates an intra-group alternating pitch sequence for a tonal pattern of one embodiment where the inter-group temporal spacing 410 is at least twice the amount of the intra-group temporal spacing 400.

FIG. 6 is an example tonal pattern illustrating an inter-group alternating pitch sequence used in one gas detector embodiment. Other pitch variance sequences similar but not limited to those shown in FIG. 3, FIG. 4 and FIG. 5 (inter-group alternating, intra-group ramping and intra-group alternating, respectively) may be used for gas detectors in other embodiments. Still other tonal patterns and pitch sequences may be used for other ambient conditions.

In at least one embodiment, a housing is used to enclose components such as, but not limited to, the control electronics, the ambient condition sensor, and the audio output transducer. The housing permits the ambient condition sensor to sense at least one ambient condition originating outside of the housing through openings or optical sensors viewing through the housing wall as well as with sensors within the housing such as, but not limited to, smoke sensors, fire sensors, thermal sensors, gas sensors, vibration sensors, motion sensors, and radiation sensors.

The various embodiments described above are merely descriptive and are in no way intended to limit the scope of the invention. Modification will become obvious to those skilled in the art in light of the detailed description above, and such modifications are intended to fall within the scope of the appended claims. It is to be understood that no limitation with respect to the specific apparatus illustrated herein is intended or should be inferred.

I claim:

1. An ambient condition detector comprising:

an ambient condition sensor to sense a presence of at least one ambient condition;

the ambient condition sensor comprises at least one of a smoke sensor, a fire sensor, a thermal sensor, a gas sensor, a motion sensor, or a radiation sensor;

control electronics emit a first audible tone group through a first audio transducer and a second audible tone group through a second audio transducer when the ambient condition sensor senses the presence of the at least one ambient condition;

the first audible tone group comprises a first pitch tone and the second audible tone group comprises a second pitch tone whereby the first pitch tone and the second pitch tone comprise distinctly different pitches; and a time interval between emission of the first audible tone group and emission of the second audible tone group whereby during the time interval, no audible tone is emitted by either the first or second audio output transducer.

2. The ambient condition detector of claim 1 wherein the first audible tone group and the second audible tone group comprise an alternating inter-group pitch sequence.

3. The ambient condition detector of claim 1 wherein the first audible tone group and the second audible tone group comprise an alternating intra-group pitch sequence.

4. The ambient condition detector of claim 1 wherein the first audible tone group and the second audible tone group comprise a ramped intra-group pitch sequence.

5. The ambient condition detector of claim 1 wherein the first pitch tone and the second pitch tone differ by a fundamental frequency of at least 750 Hz.

6. The ambient condition detector of claim 1 wherein the first pitch tone is on the order of 3000 Hz and the second pitch tone is less than 3000 Hz.

7. The ambient condition detector of claim 1 wherein the second pitch tone is on the order of 3000 Hz and the first pitch tone is less than 3000 Hz.

8. The ambient condition detector of claim 1 wherein at least one of the first pitch tone and the second pitch tone facilitates hearing by users with a deficit of high frequency hearing sensitivity.

9. An ambient condition detector to detect at least one ambient condition comprising:

control electronics with audio pitch control;

at least one ambient condition sensor, coupled to the control electronics with audio pitch control, to sense an ambient condition;

the at least one ambient condition sensor comprises at least one of a smoke sensor, a fire sensor, thermal sensor, a gas sensor, a motion sensor, or a radiation sensor;

at least one audio output transducer coupled to the control electronics with audio pitch control;

the control electronics with audio pitch control outputs an alarm tonal pattern through the at least one audio output transducer when the at least one ambient condition sensor detects an ambient condition; and the alarm tonal pattern comprises two distinctly different tone pitches with at least one silent period within the alarm tonal pattern occurring between the two distinctly different tone pitches so an alarm tonal pattern emitted by the at least one audio output transducer may be heard by a wide range of users including users with a hearing sensitivity deficit.

10. The ambient condition detector of claim 9 wherein the tonal pattern comprises a ramped intra-group pitch sequence.

11. The ambient condition detector of claim 9 wherein the tonal pattern comprises an alternating intra-group pitch sequence.

12. The ambient condition detector of claim 9 wherein the tonal pattern comprises an alternating inter-group pitch sequence.

13. The ambient condition detector of claim 9 wherein the two distinctly different tone pitches differ by a fundamental frequency of at least 750 Hz.

14. The ambient condition detector of claim 9 wherein the tonal pattern contains at least one tone pitch to facilitate hearing by users with a deficit of high frequency hearing sensitivity.

15. An ambient condition detector comprising:

an ambient condition sensor to sense at least one ambient condition;

the ambient condition sensor comprises at least one of a smoke sensor, a fire sensor, a thermal sensor, a gas sensor, a motion sensor, or a radiation sensor;

control electronics with audio pitch control emit an alarm tonal pattern comprising a first audible tone emitted by a first audio transducer and a second audible tone emitted by a second audio transducer when the ambient condition sensor senses at least one ambient condition;

the first audible tone comprises a first pitch and the second audible tone comprises a second pitch whereby the first pitch and the second pitch are distinctly different; and the alarm tonal pattern further comprises at least one time interval between emission of the first audible tone and emission of the second audible tone whereby during the at least one time interval, no audible tone is emitted by either the first or second audio output transducer.

16. The ambient condition detector of claim 15 wherein the first pitch and the second pitch differ by a fundamental frequency of at least 750 Hz.

17. The ambient condition detector of claim 15 wherein the alarm tonal pattern contains at least one audible tone to facilitate hearing by users with a deficit of high frequency hearing sensitivity.

18. The ambient condition detector of claim 17 wherein the alarm tonal pattern comprises a ramped intra-group pitch sequence.

19. The ambient condition detector of claim 17 wherein the alarm tonal pattern comprises an alternating intra-group pitch sequence.

20. The ambient condition detector of claim 17 wherein the alarm tonal pattern comprises an alternating inter-group pitch sequence.

* * * * *